United States Patent [19]

Kunisch

[11] Patent Number: 5,035,319

[45] Date of Patent: Jul. 30, 1991

[54] JEWELRY STORAGE CASE

[76] Inventor: Hans P. Kunisch, 344 Colebourne Rd., Rochester, N.Y. 14609

[21] Appl. No.: 536,158

[22] Filed: Jun. 7, 1990

[51] Int. Cl.[5] ..... A45C 11/00; B65D 6/00

[52] U.S. Cl. ..... 206/6.1; 206/566

[58] Field of Search ..... 206/566, 6.1

[56] References Cited

U.S. PATENT DOCUMENTS

| | | | |
|---|---|---|---|
| 2,739,697 | 6/1953 | Kuddes | 206/566 |
| 2,797,806 | 7/1957 | Davis | 206/566 X |
| 4,120,394 | 10/1978 | Soltes | 206/566 |
| 4,311,235 | 1/1982 | Titus | 206/566 |
| 4,371,077 | 2/1983 | Solitt et al. | 206/566 X |
| 4,420,084 | 12/1983 | Whelan | 206/566 |
| 4,848,585 | 7/1989 | Snyder | 206/566 |

FOREIGN PATENT DOCUMENTS

| | | | |
|---|---|---|---|
| 062613 | 10/1982 | European Pat. Off. | 206/566 |
| 2125750 | 12/1972 | Fed. Rep. of Germany | 206/566 |

*Primary Examiner*—William I. Price

*Attorney, Agent, or Firm*—Marjama & Pincelli

[57] ABSTRACT

A jewelry case capable of holding large and/or small jewelry in an organized manner. The base receptacle is provided with at least one upwardly extending wall which forms a closed area for holding jewelry.

29 Claims, 6 Drawing Sheets

JEWELRY STORAGE CASE

BACKGROUND OF THE INVENTION

The present invention relates generally to jewelry storage cases, and more particularly, to a jewelry storage case for organizing and storing jewelry in an orderly fashion.

In today's society it is quite normal for an individual to have a large number of different type and size jewelry items such as necklaces, rings, earrings, bracelets and the like. Typically with prior art jewelry cases, jewelry is simply placed loosely in various open compartmental areas. A problem with maintaining loose earrings and similar like articles is that they are difficult to locate and also become tangled in with other pieces of jewelry. Additionally, necklaces and bracelets that are simply placed in individual compartments often become tangled within itself making its retrieval much more difficult. This problem becomes even more severe if one attempts to take the jewelry case on trips as the items therein are typically left to bounce around in a haphazard fashion such that they become entangled and mixed with each other making it extremely difficult and time-consuming in retrieving the article. A further disadvantage of prior art jewelry cases is that they typically make no provision for holding large or long pieces of jewelry in an organized manner, leaving the large jewelry to be simply placed in a pile in a large compartment area. This also presents the problem that the large jewelry will become tangled with itself or other pieces of jewelry.

Applicants have invented a jewelry case which provides for a high degree of organization of both small and large jewelry and which also assists in minimizing jewelry from mixing with each other, thus making it easier to retrieve desired jewelry items.

SUMMARY OF THE INVENTION

In one aspect of the present invention there is provided a jewelry storage case for securely holding in place both large and small jewelry. The case comprises a base receptacle having a bottom surface and a peripherally extending outer wall. The base receptacle has at least one upstanding wall member extending upward from the bottom surface terminating in an upper terminal end forming a substantially closed receptacle area for holding jewelry. A lid is hingedly mounted to the base receptacle about a first axis. A shelf is hingedly mounted to the lid or base about a second axis and has a top surface and a bottom surface. The shelf is mounted such that when the lid is in the closed position the bottom surface is in substantial contact with the terminal end of said upstanding wall member. The shelf is provided with means for holding jewelry.

In another aspect of the present invention there is provided a jewelry storage case for securely holding in place both large and small jewelry. The case includes a base receptacle having a bottom surface and a peripherally extending outer wall. The base receptacle has at least one upstanding wall member extending upward from the bottom surface terminating in an upper terminal end forming a substantially closed receptacle area for holding jewelry. The case further includes a lid hingedly mounted to the base receptacle about a first axis. The terminal end of at least one upstanding wall being in contact or closely adjacent the interior of the lid.

In yet another aspect of the present invention there is provided a jewelry storage case for securely holding in place both large and small jewelry. The case includes a base receptacle which has a bottom surface and a peripherally extending outer wall. The base receptacle has at least one upstanding wall member extending upward from the bottom surface terminating in an upper terminal end forming a substantially closed receptacle area for holding jewelry. The case further includes means for substantially contacting or being placed closely adjacent the upper terminal end for maintaining jewelry in place when the lid is closed on the base receptacle.

DETAILED DESCRIPTION OF THE PREFERRED EMBODIMENT

Figure 1:
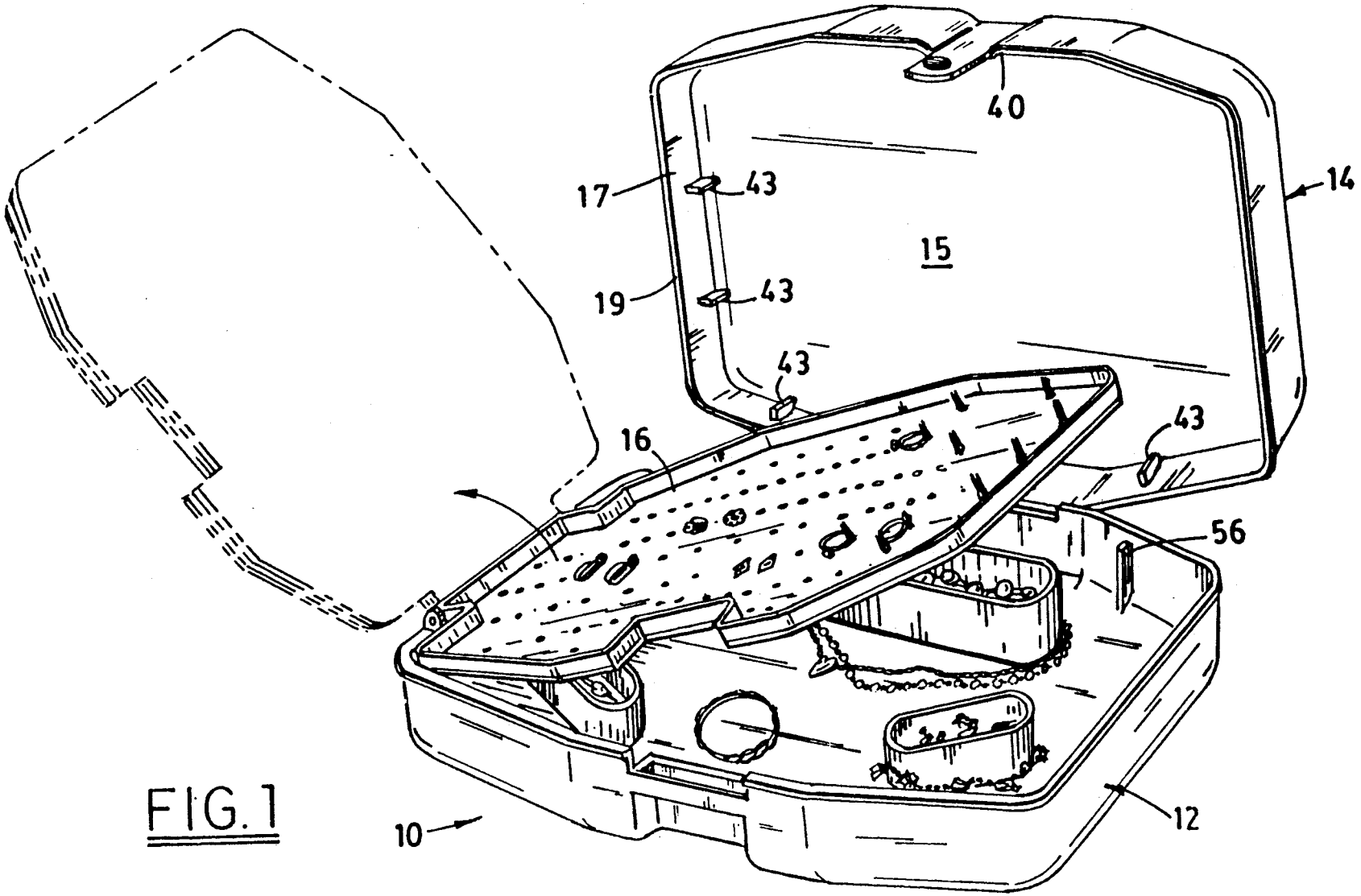
FIG. 1 is a perspective view of a jewelry case made in accordance with the present invention, in an open condition, illustrating in phantom lines how a shelf disposed therein may be rotated.

Referring to the drawings, there is illustrated a jewelry storage case 10 made in accordance with the present invention which includes a base receptacle 12, a lid 14 hingedly mounted to the base receptacle 12 and a shelf 16 which is also hingedly mounted to base receptacle 12 for placement inside and between said base receptacle 12 and lid 14. The base receptacle 12 is preferably an integrally molded plastic unit having a bottom wall 18 and peripherally extending outer wall 20 which extends upwardly from said bottom wall 18 and terminates in an outer rim 22. Three small feet 23 are integrally molded to the exterior of bottom wall 18 so as to provide stability to base receptacle 12.

The base receptacle 12 in the particular embodiment illustrated is provided with three substantially internal compartment areas 24, 26 and 28, each designed to receive and retain jewelry items therein. Each of the internal compartment areas 24, 26 and 28 are formed by an upstanding wall 30 which extends from the bottom wall 18 and terminates in an upper terminal end 32. The specific configuration and size of each internal compartment area 24, 26 and 28 may be varied as desired. In the particular embodiment illustrated compartment areas 26 and 28 each have a substantially oval configuration and are positioned into lower bottom left and right corners. The third internal compartment area 24 also has substantially oval configuration, but is larger in size than compartmental areas 26, 28 and is positioned approximately centrally in the upper area of the base receptacle 12.

Figure 4:
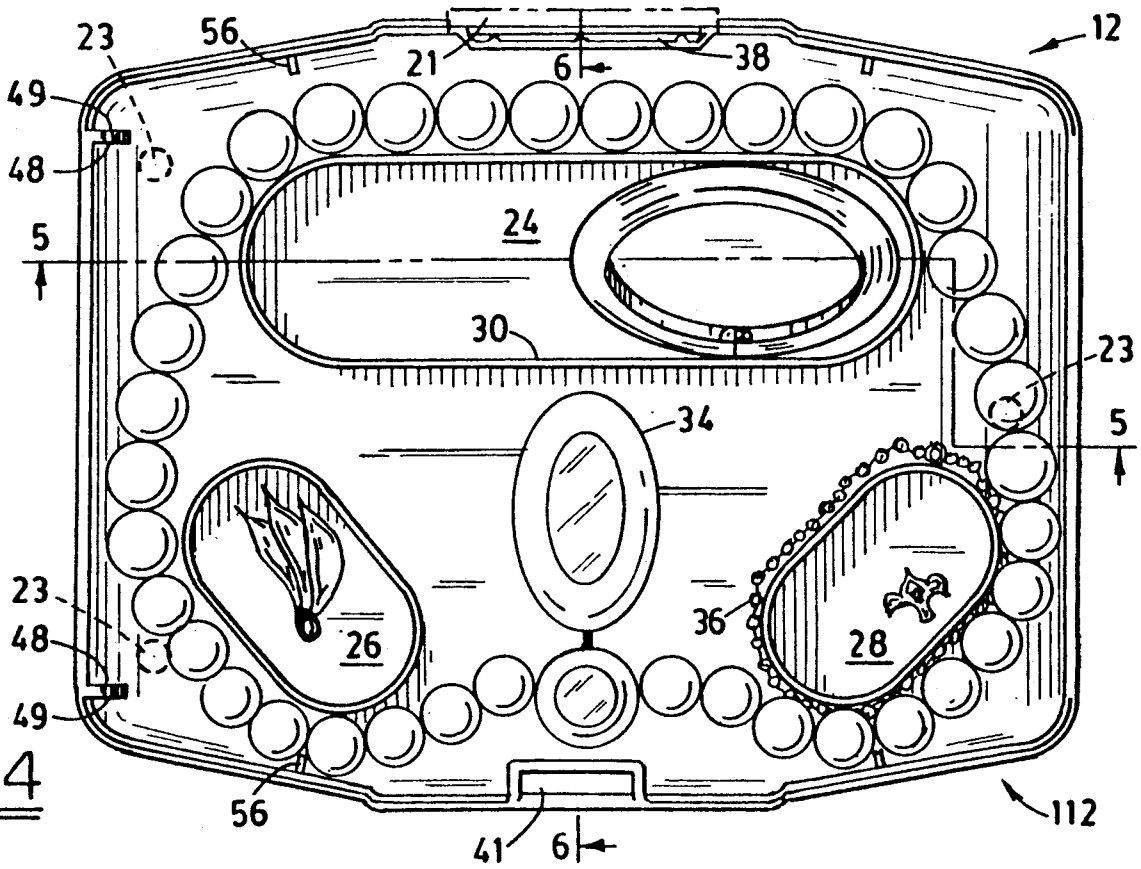
FIG. 4 is a view similar to FIG. 3 except that the rotatable shelf has been removed so as to provide a clear view of the base receptacle portion.
Figure 5:
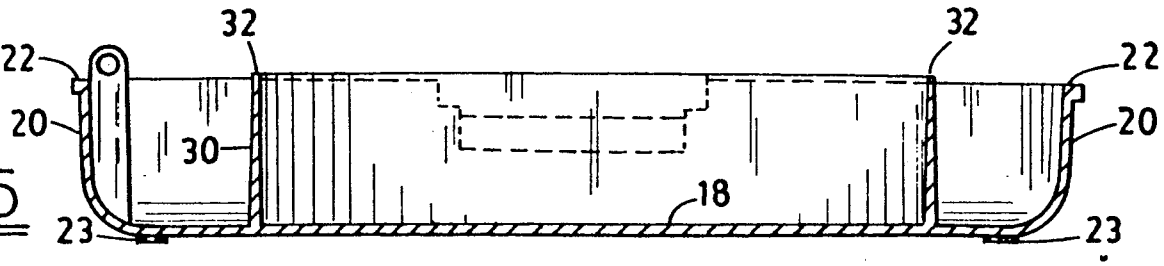
FIG. 5 is a cross-sectional view of FIG. 4 as taken along line 5—5.
Figure 10:
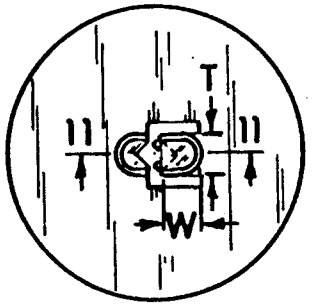
FIG. 10 is an enlarged top plan view of a portion of the shelf of FIG. 7 as outlined by line 10—10.
Figure 11:
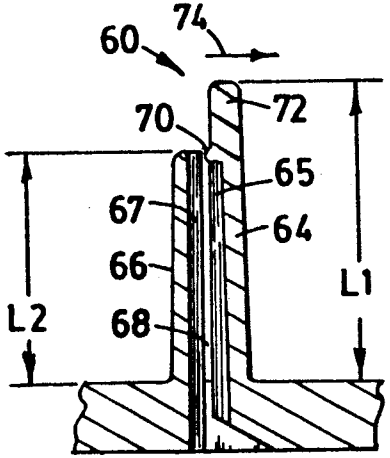
FIG. 11 is a cross-sectional view of the jewelry retention member illustrated in FIG. 10 as taken along line 11—11.
Figure 7:
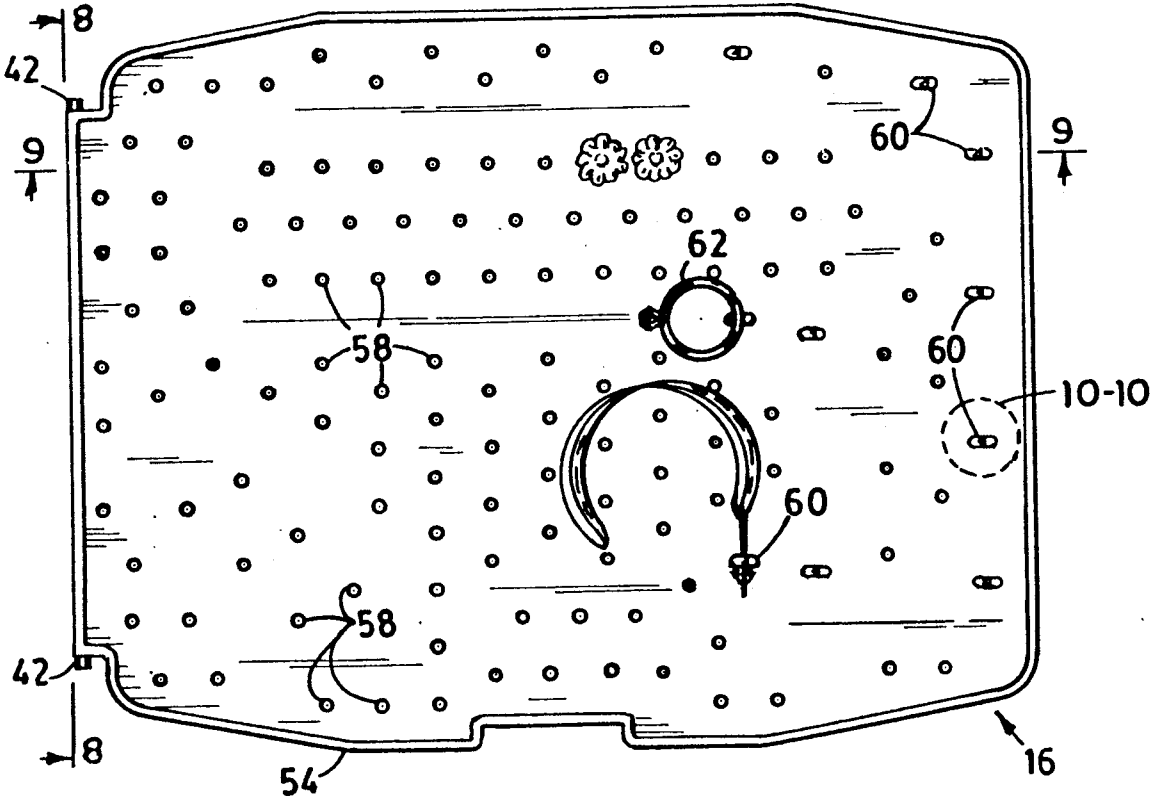
FIG. 7 is a top plan view of the shelf of FIG. 1 by itself.
Figure 8:
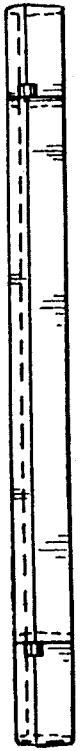
FIG. 8 is a side elevational view of FIG. 7 as taken along line 8—8.

It is, of course, understood that various configurations and sizes of internal compartment areas 24, 26, 28 may be selected as desired. Preferably as illustrated there is at least one internal compartment area, such as compartmental area 24, which is capable of holding relatively large jewelry such as hand bracelets therein. Large and long jewelry may be wrapped about the periphery of any single compartment or any combination thereof. In the particular embodiment illustrated as can best be seen in FIG. 4, a large necklace is wrapped about all three compartment areas 24, 26 and 28 with the pendant between the compartments. However, the necklace may be wrapped about any combination thereof and wrapped more than once if desired. The lower internal compartment areas 26 and 28 are spaced apart and positioned such that any pendant 34 attached to the necklace may be placed between compartmental areas 24, 26 and 28 as illustrated. As can be seen, internal compartment areas 26 and 28 can hold various types of jewelry therein such as broaches and pins while at the same time allowing smaller pieces of jewelry such as bracelet 36 about the outer peripheral wall 30. While compartment areas 24, 26 and 28 are particularly adapted for receiving and retaining therein jewelry, various other jewelry may be placed in the area between adjacent compartment areas as desired.

Figure 12:
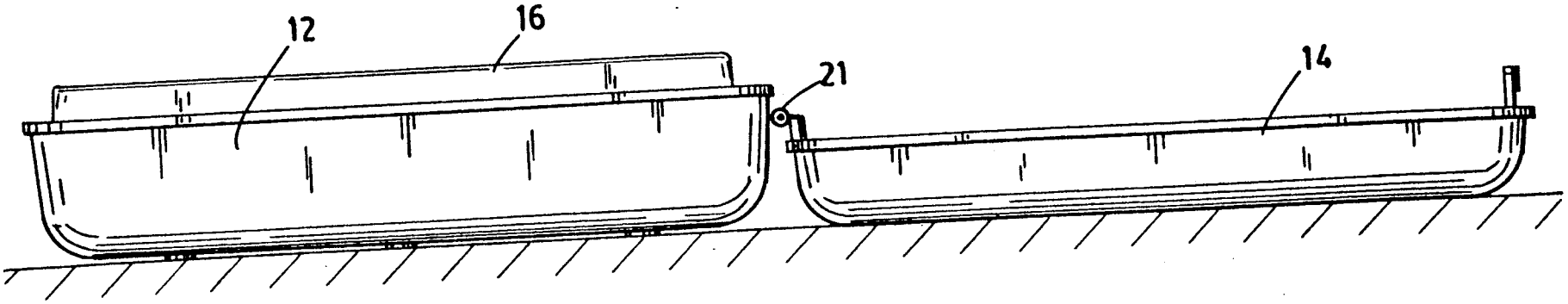
FIG. 12 is a side elevational view of the jewelry case fully opened with the lid and base receptacle resting on the same flat surface.

Referring to FIG. 1, the lid 14 is hingedly mounted to base receptacle 12 by an conventional means. The lid 14 is also preferably an integrally molded plastic unit. Lid 14 has a top wall 15 having an outer peripheral wall 17 extending therefrom and terminating in a rim 19. In the particular embodiment illustrated, the lid 14 is hingedly mounted by a metal hinge 21 having a portion secured to base receptacle 12 and a portion secured to lid 14. It is, of course, understood that the lid 14 may be hingedly mounted to base receptacle 12 in any desired fashion. The lid 14 and base receptacle is designed so that the hinge point 38 of the hinge is designed at a height H above the bottom wall 18 so that when the lid is fully opened, both the lid and base receptacle 12 will be on a flat surface (see FIG. 12) without placing any stress on the hinge, and disturbing the balance of the jewelry case.

Clasp means is also provided for locking the lid 14 to the base receptacle 12. In the particular embodiment illustrated there is provided a projection 40 on the inside of wall 17 in the forward portion of lid 14 which is designed to engage and lock into an opening 41 provided in the front portion of base receptacle 12. Here again, the particular latch means for securing the lid to base receptacle may be varied as desired. The lid 14 is provided with a plurality of projection 43 designed to mate with the shelf 16 in the closed position to assist in firmly holding shelf 16 in a secure position as will be discussed later herein.

Referring to FIGS. 1 and 7–9, there is illustrated shelf 16 hingedly mounted to base receptacle 12 by a pair of pins 42 which are designed to rotate within openings 48 formed in mounting projections 49 designed to receive pins 42. As illustrated the shelf 16 is preferably designed to be hingedly mounted for rotation in a direction different than that which the lid 14 is rotated. Preferably as illustrated shelf 16 is designed to rotate in a direction 90° different from that of the lid 14 to allow easier access to the jewelry case and shelf 16. However, shelf 16 may be hingedly mounted for rotation in any desired direction with respect to the base and lid. The shelf is preferably molded as single piece out of an appropriate plastic material. In the embodiment illustrated shelf 16 is made of high impact polystyrene.

Figure 2:
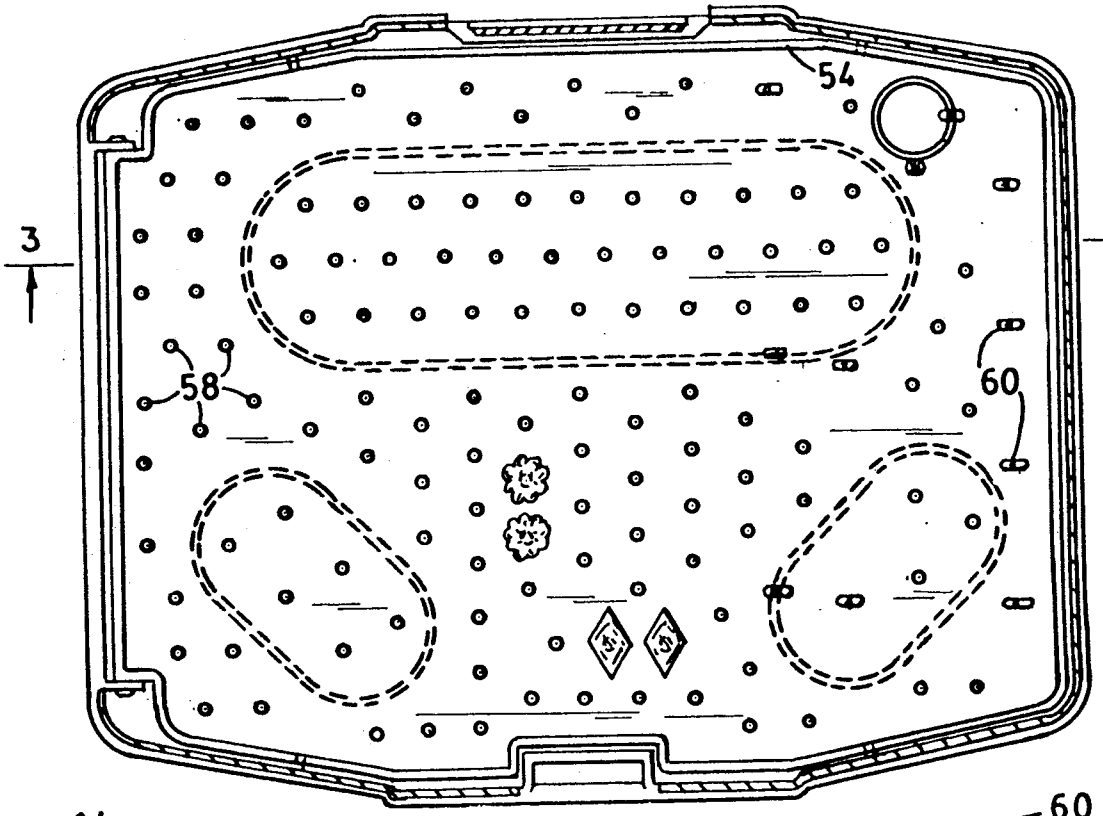
FIG. 2 is top plan view of the jewelry case of FIG. 1, in the open condition and the tray in the down position.
Figure 3:
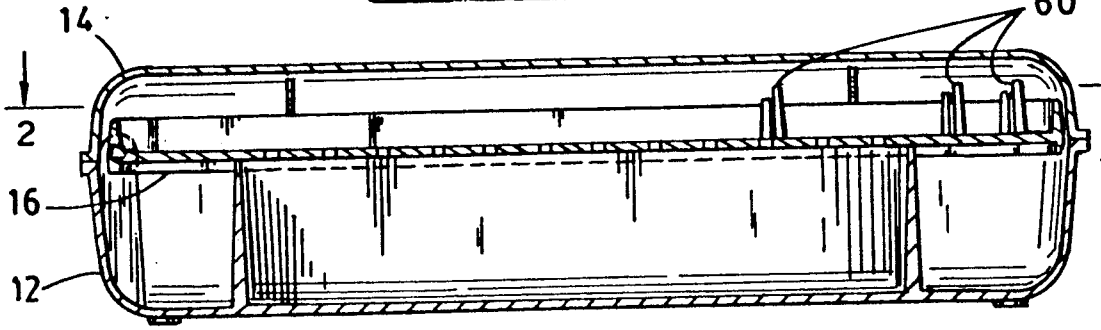
FIG. 3 is a cross-sectional of the jewelry case of FIG. 2 as taken along line 3—3.
Figure 6:
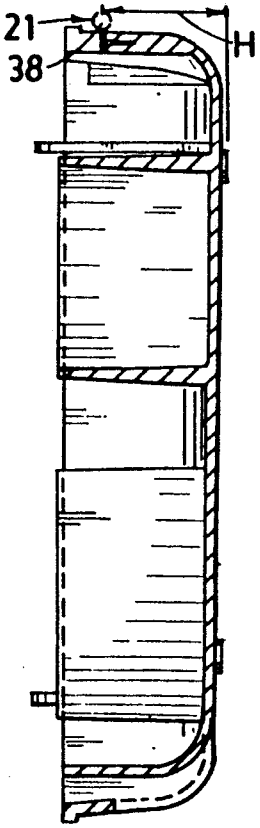
FIG. 6 is a side cross-sectional view of the receptacle FIG. 4 as taken along lines 6—6.
Figure 9:
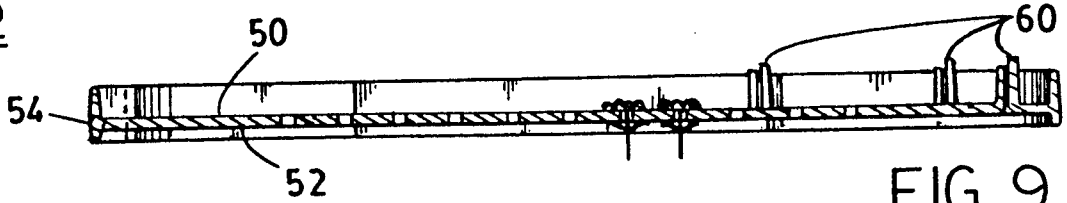
FIG. 9 is a cross-sectional view of the shelf of FIG. 7 as taken along line 9—9.

The shelf 16 has a top surface 50 and bottom surface 52 and peripheral edge 54 which extends above the top and bottom surfaces 50, 52. In the particular embodiment illustrated the peripheral edge 54 is designed to be closely adjacent the peripheral extending outer wall 20 so as to allow easy rotation of a shelf from the closed position as illustrated in FIG. 2 to the opened position as illustrated by phantom lines in FIG. 1. Preferably the peripheral edge 54 is disposed closely adjacent to avoid the possibility of any jewelry placed above or below to pass by shelf 16. Thus, the outer peripheral edge 54 has a configuration which substantially follows the configuration of the internal peripherally extending outer wall 20. The bottom surface 52 of shelf 16 preferably comes in substantial mating contact or is closely adjacent with the upper terminal end 32 of internal compartment area 24, 26 and 28. This prevents any jewelry that is placed within the compartment areas 24, 26, 28 from being mixed with the jewelry placed outside that particular compartment area. Additionally, the shelf 16 being in substantial contact with the upper terminal end 32 prevents any jewelry disposed around the outer periphery of the upstanding wall 30 of the compartmental areas from coming off during transit preventing the jewelry from becoming entangled with itself and with other jewelry. Additional support for shelf 16 is provided by stops 56 molded into the peripheral extending outer wall 20 which allow the peripheral edge 54 of shelf 16 to rest on when the shelf 16 is in the closed position as illustrated in FIGS. 2 and 3. The shelf 16 is provided with a plurality of openings 58 designed for receiving therethrough the post of jewelry such as a pierced earring. The pierced earring may be securely attached to shelf 16 by having the back portion of the earring on the bottom surface of the shelf and the decorative ornamental part on the other top side as illustrated in FIGS. 1, 2 and 9. The position of openings 58 are preferably positioned, as illustrated, so as to not interfere with the peripheral pattern formed by the upper terminal end 32 of compartment areas 24, 26 and 28 as can be seen in FIG. 2. Thus, the user will be prevented from placing a piece of jewelry in a position that will prevent the shelf from being placed fully down and contact with the upper terminal end 32.

The shelf 16 may be also further provided with additional jewelry attachment securing means of the type for clampingly holding various other type jewelry, such as a ring 62 therebetween such as illustrated in FIGS. 1 and 2. Referring to FIGS. 7–11 there is illustrated a plurality of clasp-type member 60 for holding various jewelry items. The clasp-type member 60 comprises an upper longitudinally extending projection 64 and a lower mating longitudinal projection 66 which are spaced apart so as to form a retention space 68 therebetween. The upper and lower projection 64, 66 each have mating surfaces, 65, 67, respectively, which in the particular embodiment illustrated are substantially V-shaped to assist in holding various shaped articles. The projections 64, has a length L1 and projection 66 has a length L2 sufficient to allow projections to be separated to allow jewelry to be placed therebetween in space 68 and when released will typically apply a clamping force to the jewelry. A nipple projecting portion 70 is provided on upper projection 64 to assist in retaining any jewelry placed thereon by preventing movement in the longitudinal direction there passed. This becomes more important as the pieces of jewelry becomes smaller and little or no clamping force is applied to the jewelry. In order to place a piece of jewelry, such as large earrings thereon, the forward extending tip 72 which extends passed the lower projection 66 portion is moved up as illustrated by arrow 74 to allow a piece of jewelry such as a ring or the post of a large earring, for example, of several inches in size, to be placed in the space 68 therebetween and then released. The releasing action of the upper projecting portion will cause the upper projection 64, 66 to come to their normal position. If the jewelry is large enough a clamping force will be provided thereby clampingly holding the jewelry therebetween. It is of course understood that any desired type jewelry may be placed therebetween and the particular shape and configuration of the projection 64, 66 may be varied to accommodate a variety of jewelry. Additionally, the shelf 16 is preferably made out of a plastic material that allows the longitudinal projections 64, 66 to provide a degree of flexibility to allow placement and removal of jewelry therebetween.

In the particular embodiment illustrated, the shelf 16 is made out of high impact plastic and the longitudinal projections 64, 65 have a length L1 of about 15/32" (1.19 cm), a length L2 of about 11/32" (0.873 cm), a thickness T of about 3/32" (0.238 cm) and width W of about ⅛" (0.3175 cm). It is, of course, understood that depending upon the configuration and material from which the projections 64, 66 and shelf member are made from, these dimensions may be varied as desired to provide the appropriate degree of flexibility required to hold the desired jewelry.

Additionally, while clasp-type members 60 are illustrated as being somewhat randomly spaced on the shelf, if so desired, they may be placed to correspond to the outer periphery of the terminal upper end 32 of compartmental areas 24, 26 and 28 thus more effectively utilize substantially all of the area of the shelf 16. Additionally, if so desired, clasp-type members 60 may be placed on both top and bottom surfaces of shelf 16.

In order to more fully understand the operation of the present invention, the applicant will now describe the manner used. Initially, the lid 14 is rotated in the open position, such as illustrated in FIG. 1 so as to allow the shelf 16 to freely rotate to the position illustrated in phantom line. Thereafter, the appropriate jewelry is either placed thereon or removed from the jewelry case as desired. Once the user has finished the shelf is rotated to the closed position as illustrated in FIG. 2 and the lid placed in the closed position as illustrated in FIG. 3. Projections 43 on lid 14 assist in securely holding shelf 16 in a substantially fixed position such that shelf 16 remains in substantially contact with terminal ends 32 and/or stops 56 of base receptacle 12 during movement of the case 10.

One of the benefits of the present invention is that not only is the jewelry organized in a convenient manner for the user, the present invention also minimizes or eliminates the amount of mixing of jewelry therein when the jewelry case is taken on trips wherein the jewelry case is placed in all sorts of positions during transportation thereof. Additionally, the configuration and design of the jewelry case allows a wide variety of different type and size jewelry to be held in a secure manner.

Figure 13:
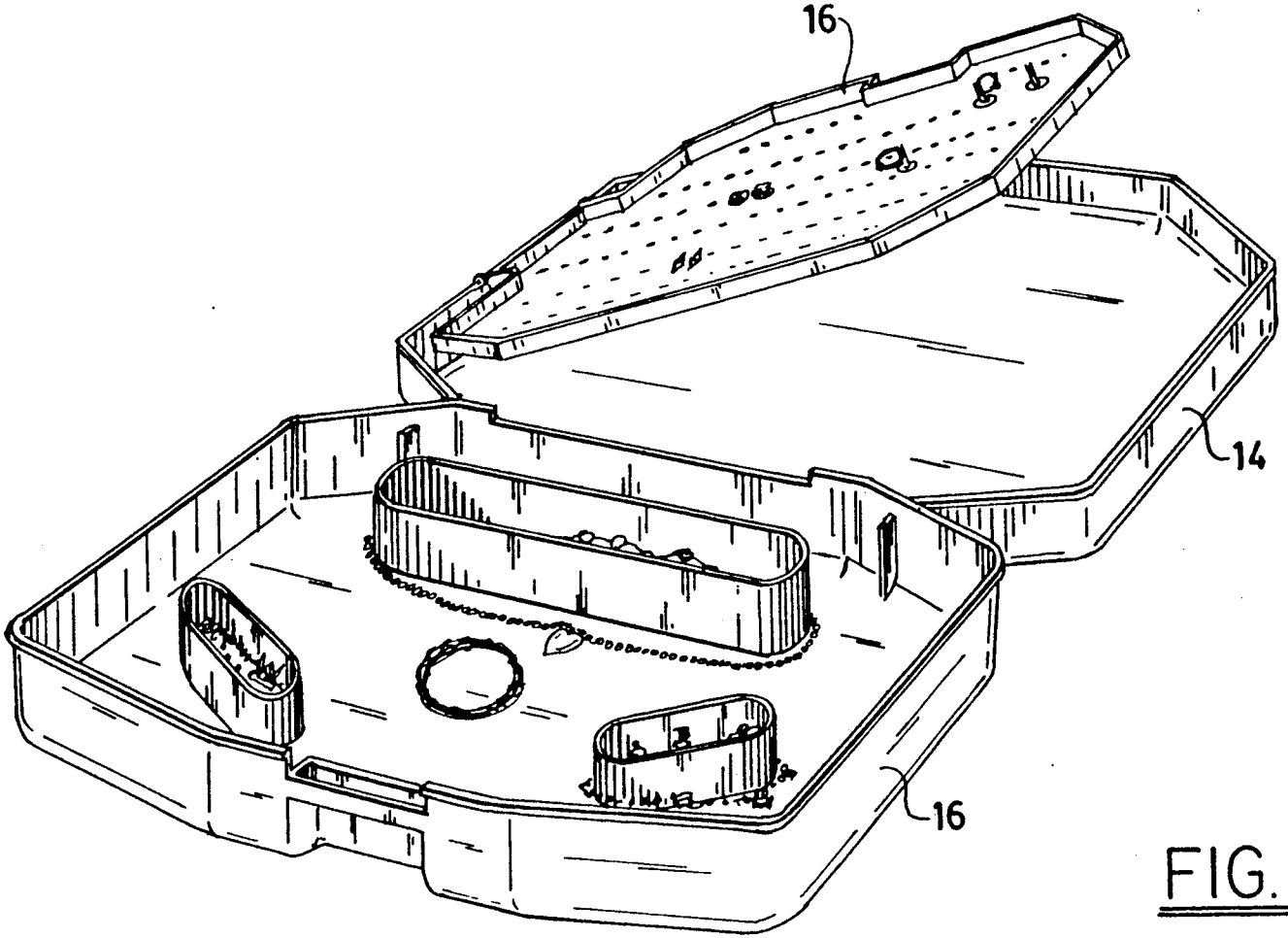
FIG. 13 is a perspective view of a modified jewelry case made in accordance with the present invention, in the open condition.

It is, of course, understood that various modifications and changes may be made without departing from the scope of the present invention. For example, but not by way of limitation, more than one shelf 16 may be provided therein. In such case, a second shelf may be designed to rotate in the opposite or same direction as illustrated thus providing greater possibility of holding additional jewelry. Additionally, while the preferred embodiment illustrates the shelf as being hingedly mounted to the base receptacle, it may be mounted to the cover if so desired in which case the lid would be capable of rotating to the completely flat position adjacent the base thereby allowing further storage and ease of retrieval of the jewelry (see FIG. 13). Additionally, if so desired, the lid may be provided with internal compartment areas which operate in the same manner discussed with internal compartment areas associated with the base receptacle. Yet further, the shelf may be entirely omitted and the walls of the compartment areas be extended upwards until it contacts or is closely adjacent the interior of the lid. This would be more economical to make, yet have the ability to hold and organize both large and small pieces of jewelry. Additional clasp-type members 60 may be placed on the interior of the lid at locations that don't interfere with the compartment areas provided. This can be used to hold jewelry items as desired.

The present invention being limited by the following claims.

I claim:

1. A jewelry storage case for securely holding large and small jewelry comprising:

a base receptacle having a bottom surface and a peripherally extending outer wall, said base receptacle having at least one upstanding wall member extending upward from said bottom surface terminating in an upper terminal end forming a substantially closed receptacle area for holding jewelry;

a lid secured to said base receptacle by first hinge means such that said lid can rotate about a first axis; and a shelf secured to said base by a second hinge means such that said shelf rotates about a second axis, said shelf having a top surface and a bottom surface; said shelf being mounted to said base receptacle such that when said lid is in the closed position said bottom surface is in substantial contact or closely adjacent with said terminal end of said upstanding wall member, said shelf having means for holding jewelry.

2. A jewelry storage case according to claim 1 wherein said means for holding small jewelry on said shelf is located such that it will not interfere with said shelf coming in contact with said terminal end of said upstanding wall.

3. A jewelry storage case according to claim 1 wherein said means for holding small jewelry comprises a plurality of openings extending through said shelf.

4. A jewelry storage case according to claim 1 wherein said means for holding small jewelry comprises a pair of projections extending substantially perpendicular from the surface of said top or bottom surface of said shelf and being designed to substantially clasp therebetween a piece of jewelry.

5. A jewelry storage case according to claim 4 wherein said pair of projections is provided with means for preventing said jewelry coming out from between said projections, said means comprising a projecting portion on at least one of said projections extending toward the other of said projection.

6. A jewelry storage case according to claim 1 wherein there are provided three separate upstanding wall members each providing a substantially closed receptacle area.

7. A jewelry storage case according to claim 1 wherein said second axis is located in a different direction with respect to said first axis such that said shelf and lid rotate in different directions.

8. A jewelry storage case according to claim 1 further comprising means for locking said lid to said base receptacle when said lid is in the closed position.

9. A jewelry storage case according to claim 1 wherein said lid is hingedly mounted to said base receptacle such that both can lie substantially flat on the same flat surface.

10. A jewelry storage case according to claim 1 further comprising means for securely holding said shelf in a substantially fixed position when said lid is closed on said base receptacle.

11. A jewelry storage case according to claim 10 wherein said means for securely holding said shelf comprises a plurality of projections on said lid which engages the top of said lid so as to cause said lid to substantially contact said terminal ends and/or stop provided in said base recepticle.

12. A jewelry storage case for securely holding in place both large and small jewelry comprising:

an integrally molded base receptacle made of a plastic material having a bottom surface and a peripherally extending outer wall, said base receptacle having at least one upstanding wall member integrally formed with said base receptacle extending upward from said bottom surface and terminating in an upper terminal end forming a substantially closed receptacle area for holding loose jewelry; and a lid mounted to said base receptacle by a first hinge means such that said lid rotates about a first axis, said terminal end of said at least one upstanding wall being in contact or closely adjacent the interior of said lid.

13. A jewelry storage case according to claim 12 wherein said lid is provided with means for holding small jewelry comprising a pair of projections extending substantially perpendicular from the surface of said lid toward said base and being designed to substantially clasp therebetween a piece of jewelry.

14. A jewelry storage case according to claim 13 wherein said pair of projections is provided with means for preventing said jewelry coming out from between said projections, said means comprising a projecting portion on at least one of said projections extending toward the other of said projection.

15. A jewelry storage case according to claim 12 wherein there are provided three separate upstanding wall members each providing a substantially closed receptacle area.

16. A jewelry storage case according to claim 12 further comprising means for locking said lid to said base receptacle when said lid is in the closed position.

17. A jewelry storage case according to claim 12 wherein said lid is hingedly mounted to said base receptacle such that both can lie substantially flat on the same flat surface.

18. A jewelry storage case for securely holding large and small jewelry comprising:

a base receptacle having a bottom surface and a peripherally extending outer wall, said base receptacle having at least one upstanding wall member extending upward from said bottom surface terminating in an upper terminal end forming a substantially closed receptacle area for holding jewelry;

a lid secured to said base receptacle by first hinge means such that said lid can rotate about a first axis; and a shelf secured to said lid by a second hinge means such that said shelf rotates about a second axis, said shelf having a top surface and a bottom surface, said shelf being mounted to said lid such that when said lid is in the closed position said bottom surface is in substantial contact or closely adjacent with said terminal end of said upstanding wall member, said shelf having means for holding jewelry.

19. A jewelry storage case according to claim 18 wherein said means for holding small jewelry on said shelf is located such that it will not interfere with said shelf coming in contact with said terminal end of said upstanding wall.

20. A jewelry storage case according to claim 18 wherein said means for holding small jewelry comprises a plurality of openings extending through said shelf.

21. A jewelry storage case according to claim 18 wherein said means for holding small jewelry comprises a pair of projections extending substantially perpendicular from the surface of said top or bottom surface of said shelf and being designed to substantially clasp therebetween a piece of jewelry.

22. A jewelry storage case according to claim 18 wherein said pair of projections is provided with means for preventing said jewelry coming out from between said projections, said means comprising a projecting portion on at least one of said projections extending toward the other of said projection.

23. A jewelry storage case according to claim 18 wherein there are provided three separate upstanding wall members each providing a substantially closed receptacle area.

24. A jewelry storage case according to claim 18 wherein said second axis is located in a different direction with respect to said first axis such that said shelf and lid rotate in different directions.

25. A jewelry storage case according to claim 18 further comprising means for locking said lid to said base receptacle when said lid is in the closed position.

26. A jewelry storage case according to claim 18 wherein there is provided at least two shelves each hingedly mounted to said lid or base receptacle.

27. A jewelry storage case according to claim 18 wherein said lid is hingedly mounted to said base receptacle such that both can lie substantially flat on the same flat surface.

28. A jewelry storage case according to claim 18 further comprising means for securely holding said shelf in a substantially fixed position when said lid is closed on said base receptacle.

29. A jewelry storage case according to claim 18 wherein said means for securely holding said shelf comprises a plurality of projections on said lid which engages the top of said lid so as to cause said lid to substantially contact said terminal ends and/or stop provided in said base receptacle.

* * * * *